US006149292A

United States Patent [19]

Degrande

[11] Patent Number: 6,149,292

[45] Date of Patent: Nov. 21, 2000

[54] OSCILLATING TABLE, IN PARTICULAR FOR USE IN A CONTINUOUS CASTING MACHINE

[75] Inventor: Hubert Degrande, Ghent, Belgium

[73] Assignee: Sidmar N.V., Ghent, Belgium

[21] Appl. No.: 09/029,182

[22] PCT Filed: Aug. 23, 1996

[86] PCT No.: PCT/BE96/00089

§ 371 Date: Jul. 24, 1998

§ 102(e) Date: Jul. 24, 1998

[87] PCT Pub. No.: WO97/07910

PCT Pub. Date: Mar. 6, 1997

Related U.S. Application Data

[60] Provisional application No. 60/002,818, Aug. 25, 1995.

[51] Int. Cl.[7] ..... B22D 11/04

[52] U.S. Cl. ..... 366/111; 366/128; 164/261

[58] Field of Search ..... 366/124, 125, 366/128, 108, 111, 112, 114, 116, 118, 117, 210, 211, 212, 213, 215, 216, 218, 240; 164/416, 478, 261

[56] References Cited

U.S. PATENT DOCUMENTS

| | | | |
|---|---|---|---|
| 3,407,670 | 10/1968 | Venanzetti | 366/128 |
| 3,724,819 | 4/1973 | Varnum et al. | 366/128 |
| 3,866,480 | 2/1975 | Elliston | 366/128 |
| 4,151,982 | 5/1979 | Herz | 366/114 |
| 4,202,634 | 5/1980 | Kraft et al. | 366/128 |
| 4,262,549 | 4/1981 | Schwellenbach | 366/128 |
| 4,766,771 | 8/1988 | Bailey et al. | 366/128 |
| 4,860,816 | 8/1989 | Bond | 366/116 |

FOREIGN PATENT DOCUMENTS

| | | |
|---|---|---|
| 1235705 | 11/1960 | France . |
| 1266961 | 11/1961 | France . |
| 1275262 | 2/1962 | France . |
| 2232718 | 1/1974 | Germany . |

OTHER PUBLICATIONS

Abstract of Japanese Patent Publication 57–12549.

*Primary Examiner*—Tony G. Soohoo
*Attorney, Agent, or Firm*—Merchant & Gould P.C

[57] ABSTRACT

The oscillating table comprises a movable part on which a mould of a continuous casting machine is located. The movable part is coupled via eccentrics to a driving mechanism for introducing an upward and downward oscillation motion in order to prevent the cast steel from remaining stuck to the wall of the mould. In contradistinction to the known oscillating tables according to the invention the eccentrics are not uniformly driven. To this end the driving mechanism comprises driving means for driving the eccentrics with a non-uniform angular speed. In a preferred embodiment the driving means comprise hydraulic motors provided with a control system. The hydraulic motors are electronically synchronised and as a safeguard being coupled to each other by a synchronisation shaft. In this way the facility is obtained to operate any lifting and descending motion of the casting mould.

6 Claims, 3 Drawing Sheets

OSCILLATING TABLE, IN PARTICULAR FOR USE IN A CONTINUOUS CASTING MACHINE

This application claims priority and benefit of U.S. Provisional Application Ser. No. 60/002,818 filed on Aug. 25, 1995 (See: 60 Fed. Reg. 79, at 20212, Apr. 25, 1995).

BACKGROUND OF THE INVENTION

The present invention pertains to an oscillating table, in particular for use in a continuous casting machine, comprising a movable part, coupled via an eccentric to a driving mechanism for introducing an upward and downward oscillation motion.

In a continuous casting machine, used i.a. in steel production, the oscillation table is used to impart to the casting mould an upward and downward oscillation motion, either according to a defined radius or, less frequently, along a vertical direction in order to prevent the cast steel from remaining stuck to the water-cooled copper wall of the mould.

In the presently in use oscillating tables, the applied oscillation frequency is dependent upon the casting speed. The amplitude is fixed but is generally adaptable by exchanging eccentrics.

In the upward motion of the casting mould, there is always a relative speed difference between slab, billet or bloom being formed and the casting mould.

In the downward motion of the casting mould, the speed of the casting mould is initially less than, subsequently equal and thereafter greater than, the speed of the slab, billet or bloom. Upon the end of the descending motion, the speed of the casting mould is again equal to and thereafter less than the speed of the slab.

The period during which the speed of the casting mould in the downward motion is greater than the speed of the billet is referred to as the "negative strip".

The usual driving mechanisms for oscillating tables use linear electric motors driving eccentric shafts via reduction gearboxes and driving shafts. This results in a sinusoidal movement which is not satisfactory because the time during which the speed of the slab is nearly equal to the speed of the mould during the downward movement of the mould and causes the cast steel to stuck to the wall of the mould is too long.

SUMMARY OF THE INVENTION

It is a goal of the invention to provide an oscillating table of the type mentioned hereabove, whereby the drawbacks of existing oscillating tables are avoided. To this end, the oscillating table according to the invention is characterised in that, the driving mechanism comprises driving means for driving the eccentric with a non-uniform angular speed. In this way the facility is obtained to operate any lifting and descending motion of the casting mould. By maximizing the negative strip, i.e. by raising the downward speed of the casting mould to a considerably higher value than that of the upward speed, the period during which the cast steel strikes onto the wall of the mould because of the too small difference in speed is not long enough for the cast steel to stuck to the wall of the mould.

An embodiment of the oscillating table according to the invention is characterised in that the driving means comprises a hydraulic motor provided with a control system. By way of a hydraulic motor a non-uniform angular speed of the outgoing driving shaft can be easily obtained by controlling the pressure of the supplied hydraulic oil.

An advantageous embodiment is characterised in that the control system comprises a hydraulic servo or proportional valve and an electronic controller for controlling the servo or valve.

In practice the oscillating table is nearly always driven via more than one eccentric. A further embodiment of the oscillating table according to the invention is characterised in that the driving mechanism comprises a further eccentric driven by a further hydraulic motor and means for synchronising the two hydraulic motors.

The motors need to have perfect synchronization. To this end still a further embodiment is characterised in that the synchronising means comprises measurement means for indicating the exact position of the motors, which measurement means are coupled to the control system. By interaction between the electronic controller for controlling the hydraulic servo or proportional valves and the position measurements of the motors, perfect synchronization is obtained.

A preferred embodiment is characterised in that, the synchronising means comprises a mechanical synchronisation means coupled to both hydraulic motors. This mechanical synchronisation means can be applied instead of the mentioned electronic synchronization or as a safeguard besides the electronic synchronization.

In a practical embodiment, the mechanical synchronisation means comprises a synchronisation shaft.

The invention will now be further elucidated on the basis of an example embodiment of the oscillating table according to the invention, as depicted in the drawings.

DETAILED DESCRIPTION

Figure 1:
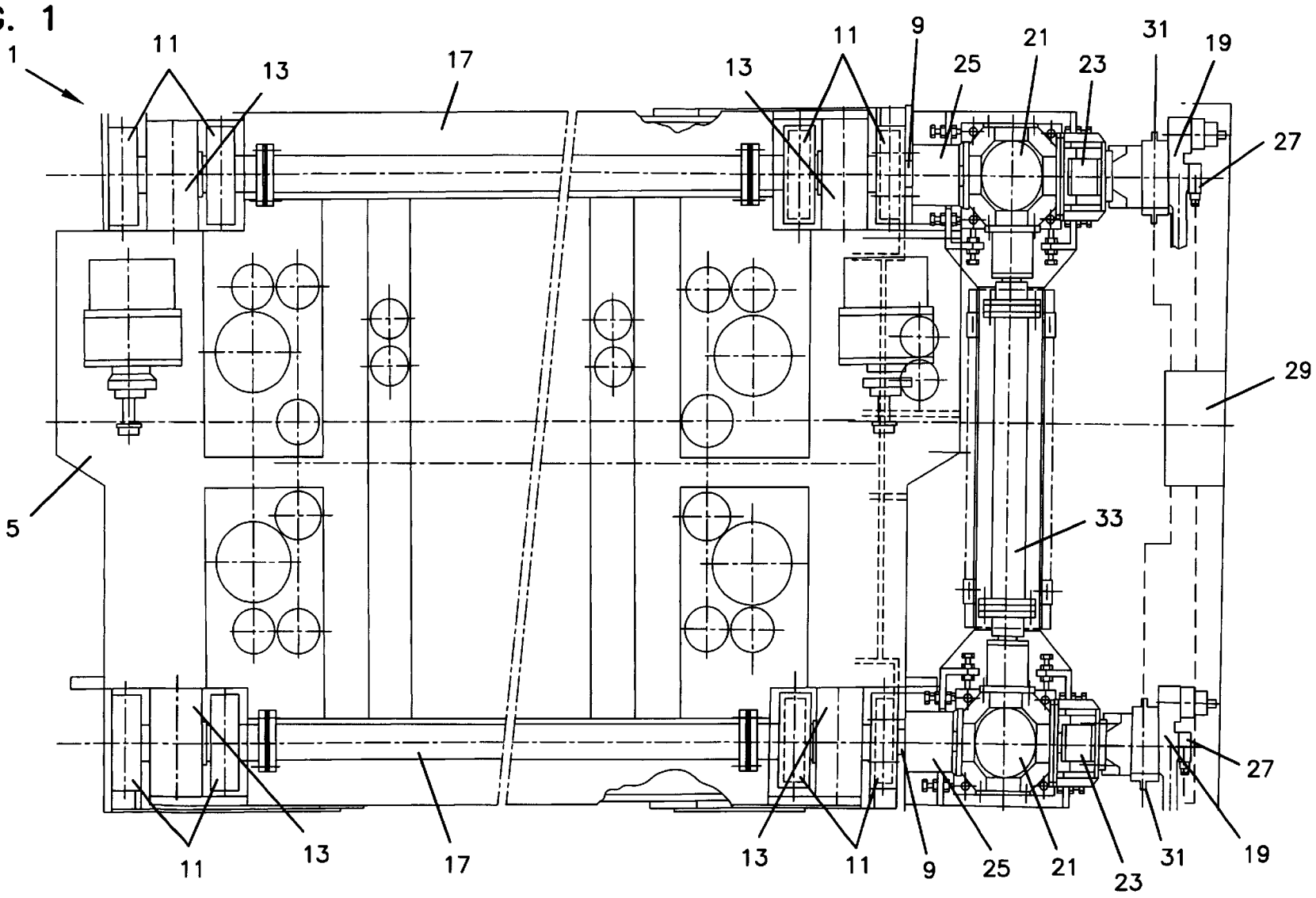
FIG. 1 shows a plan view of a oscillation table according to the invention.
Figure 2:
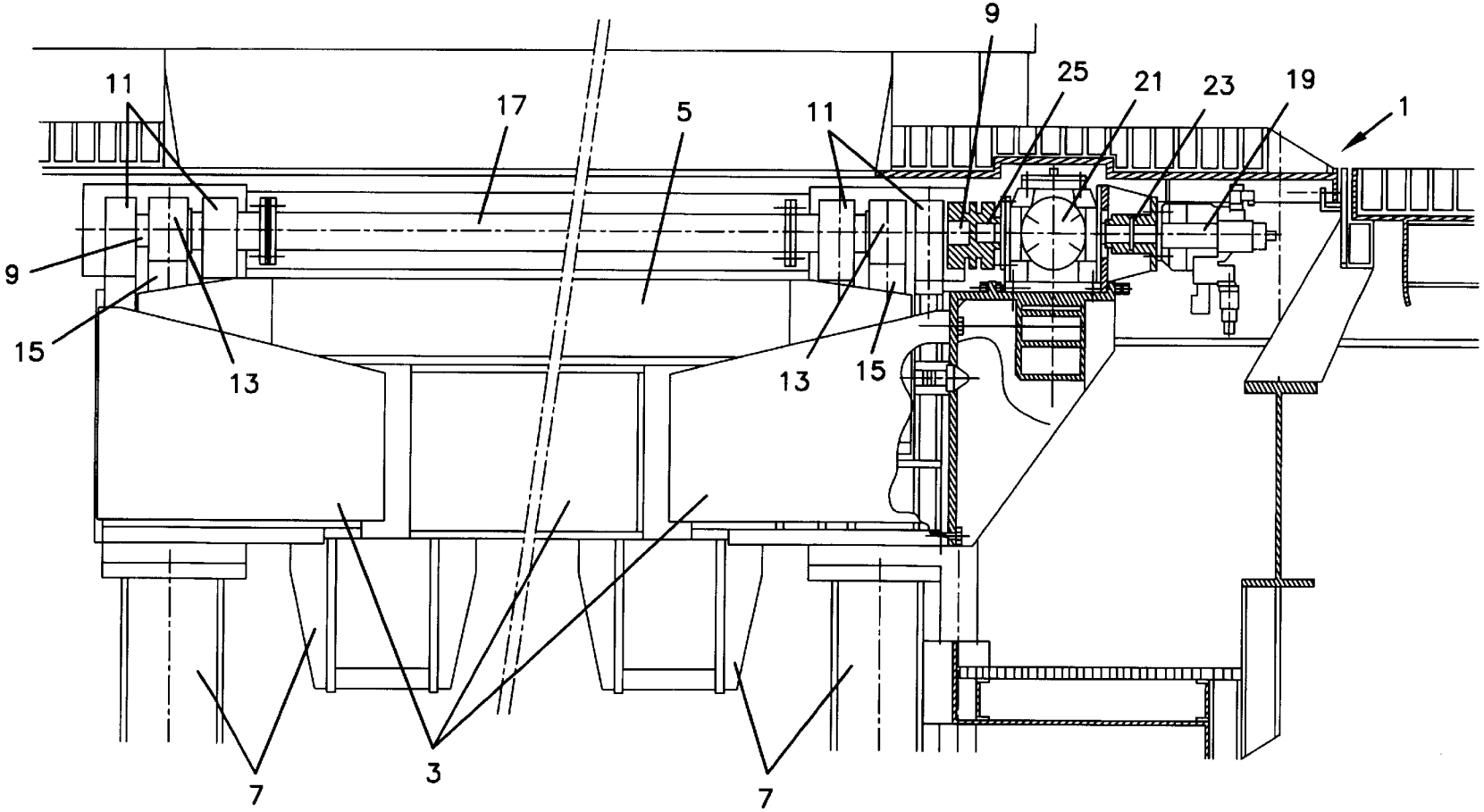
FIG. 2 shows a side view of the oscillating table.

FIGS. 1 and 2 show an oscillating table 1 according to the invention at different views. The oscillation table 1 which supports a casting mould (not shown) comprises a fixed part 3 and a moving part 5. The casting mould is tightened by four bolts on the top side of the movable part 5 (=oscillating portion). The fixed part 3 rests on the outer edges on fixed racks 7 (anchored in the concrete structure).

At each corner of the fixed part 3 there is a combined mounting with eccentric. The eccentric shaft 9 is beared in two fixed bearings 11 at each side of the eccentric 13. Attached to the eccentrics 13 are connecting rods 15, by which the moving part 5 is suspended. The eccentrics 13 are coupled to the connecting rods by moving eccentric bearings. These eccentrics 13 are connected two by two by a connecting shaft 17.

On the outer side of the fixed part 3 there are placed on the eccentric shafts 9 hydraulic motors 19, which drive the two eccentrics 13 and thus generate an upward and downward motion of the casting mould. These hydraulic motors 19 replace the usual linear electric motor which drives the eccentric shafts via reduction gearboxes and driving shafts.

Each motor 19 has a connection to a bevel gearbox 21 by teethcoupling 23. The connection between the gearbox 21 and the eccentric shaft 9 is provided with a free play elastic coupling 25.

The motors 19 are controlled by a control system. The control system comprises hydraulic servos or proportional valves 27 and an electronic controller 29 for controlling the servos or valves. The hydraulic motors 19 and the control system are part of driving means for driving the eccentrics 13 with a non-uniform angular speed.

The drive is effected with the servos or valves 27 installed as close as possible to the motors 19, possibly provided with the necessary accumulators for each motor control system.

The driving means on their turn are parts of an overall driving mechanism of the oscillating table.

The hydraulic oil is supplied under pressure. The hydraulic pressure is determined by the mass to be accelerated and the actual acceleration required.

In contradistinction to the solution of the state of the art, according to the invention the motors are not uniformly driven. During the downward motion of the casting mould, a much greater speed is indeed sought than during the upward motion. In order to make the negative strip as large as possible, the transition from high (descend) to low speed (ascend) can take place, for example, in the ascendant motion.

The braking, the transition to a uniform or non-uniform slow lifting speed and the acceleration to high descending speed takes place during the upwards motion of the slab.

In order to realise this kind of oscillation control, the angular speed of the hydraulic motors has to be continuously adjustable. With this continuous adjustment, an optional sinusoidal or other form can be set.

Figure 3:
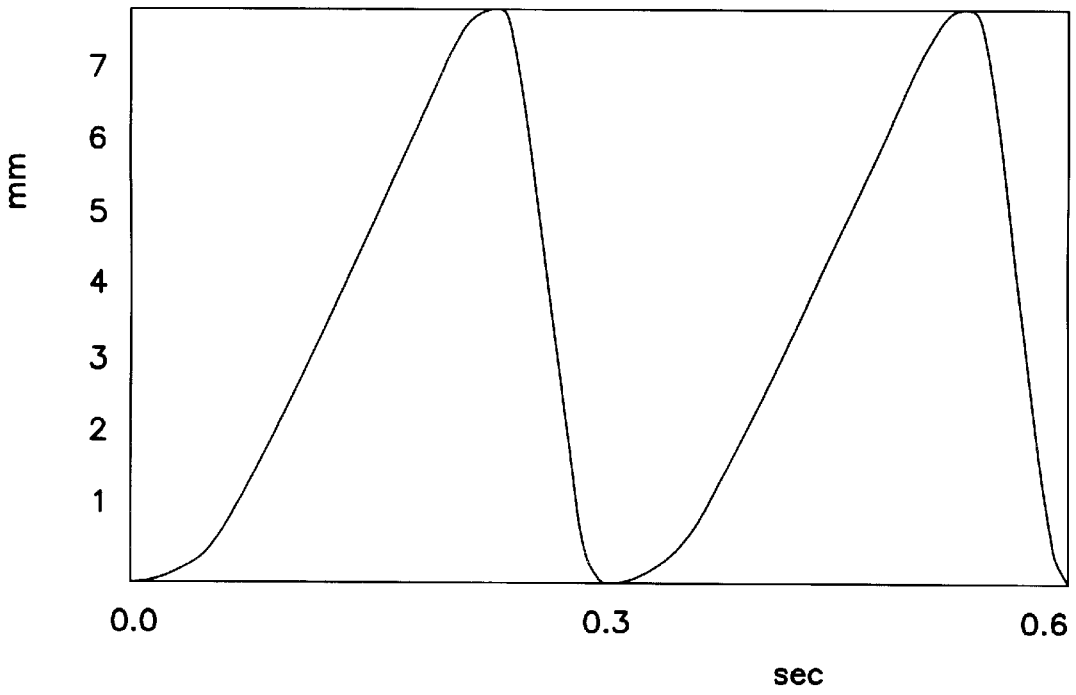
FIG. 3 shows a chart depicting a non-uniform motion of the oscillating table.

In the chart, shown in FIG. 3, an example of a non-uniform motion with fast descending and slow ascending speeds is depicted.

The hydraulic motors 19 are not uniformly driven. At each moment the speed on both motors must be equal. The speed on both motors 19 is realised by interaction of the electronic controller 29.

The position of the motor 19 is monitored by an absolute-value transmitter or pulse generator 31 for each motor or any other system which indicates the exact position of the motors.

The motors need to have perfect synchronization, which is realized by interaction between the electronic controller 29 for controlling the hydraulic servo or proportional valves 27 and the position measurements of the motors. As a safeguard, an additional mechanical synchronization i.a. a mechanical synchronization shaft 33 is provided between both gearboxes 21. If there is a failure on the electronic controller 29 for example, at this moment the mechanical synchronization guarantees that both motors 19 are in phase. Even when one of the motors 19 is out of service, both eccentric shafts 9 are still driven (one eccentric shaft is driven with the synchronization shaft at this moment).

The hydraulic motors 19 in question can be of the axial or radial type: hydraulic gear wheel or baffle motors also being possible.

By equipping an oscillation table with hydraulic motors provided with a control system which allows a variable angular speed for each revolution, the facility is obtained to operate any lifting and descending motion of the casting mould. The higher the acceleration (dependent upon the controller and the mass to be accelerated), the greater is the approximation to a sawtooth shape.

Although the invention has been elucidated on the basis of the accompanying drawings in the discussion to this point, it should be noted that the invention is in no way restricted to just this embodiment depicted in the drawings. The invention also encompasses all the derivative embodiments which differ from the depicted embodiment within the scope defined in the claims. As an example, it is also possible to omit the mechanical synchronisation shaft or to drive all eccentrics by one hydraulic motor. Further, instead of hydraulic motors, other motors can also be used which are able to excite a non-uniform motion. It is also to be noted that the oscillating table is not restricted for use in continuous casting machines but that the oscillating table in accordance with the present invention can be used anywhere where oscillating tables are applied.

What is claimed is:

1. Oscillating table, in particular for use in a continuous casting machine, comprising a movable part, coupled via two eccentrics to a driving mechanism for introducing an upward and downward oscillation motion, wherein the driving mechanism comprises driving means for driving the eccentrics with a non-uniform angular speed; and wherein the driving means comprises one hydraulic motor for each eccentric, said hydraulic motors being provided with a control system; and wherein the control system comprises for each hydraulic motor a control element chosen from the group consisting of hydraulic servo and proportional valve and an electronic controller for controlling the control elements; and wherein the driving mechanism comprises means for synchronising the two hydraulic motors.

2. Oscillating table according to claim 1, wherein the synchronising means comprises measurement means for indicating the exact position of the motors, which measurement means are coupled to the control system.

3. Oscillating table according to claim 2, wherein the synchronising means comprises a mechanical synchronisation means coupled to both hydraulic motors.

4. Oscillating table according to claim 3, wherein the mechanical synchronisation means comprises a synchronisation shaft.

5. Oscillating table according to claim 1, wherein the synchronising means comprises a mechanical synchronisation means coupled to both hydraulic motors.

6. Oscillating table according to claim 5, wherein the mechanical synchronisation means comprises a synchronisation shaft.

* * * * *